US009512671B2

(12) United States Patent
Cha

(10) Patent No.: US 9,512,671 B2
(45) Date of Patent: Dec. 6, 2016

(54) CORD EMBEDDED ROMAN SHADE

(71) Applicant: DAEKYEONG TRIPLE CO., LTD., Daegu (KR)

(72) Inventor: Sang-Gun Cha, Daegu (KR)

(73) Assignee: DAEKYEONG TRIPLE CO., LTD., Daegu (KR)

( * ) Notice: Subject to any disclaimer, the term of this patent is extended or adjusted under 35 U.S.C. 154(b) by 0 days.

(21) Appl. No.: 14/125,528

(22) PCT Filed: Nov. 6, 2013

(86) PCT No.: PCT/KR2013/009972

§ 371 (c)(1),
(2) Date: Dec. 11, 2013

(87) PCT Pub. No.: WO2014/204059

PCT Pub. Date: Dec. 24, 2014

(65) Prior Publication Data

US 2016/0123069 A1 May 5, 2016

(30) Foreign Application Priority Data

Jun. 17, 2013 (KR) ..... 10-2013-0069133
Jul. 4, 2013 (KR) ..... 10-2013-0078281
Aug. 13, 2013 (KR) ..... 10-2013-0096139

(51) Int. Cl.

| | |
|---|---|
| ***E06B 9/262*** | (2006.01) |
| ***D03D 11/00*** | (2006.01) |
| ***D03D 1/08*** | (2006.01) |
| ***E06B 9/326*** | (2006.01) |
| ***E06B 9/38*** | (2006.01) |

(52) U.S. Cl.

CPC ..... *E06B 9/262* (2013.01); *D03D 1/08* (2013.01); *D03D 11/00* (2013.01); *E06B 9/326* (2013.01); *E06B 9/38* (2013.01); *D10B 2503/02* (2013.01); *E06B 2009/2622* (2013.01); *E06B 2009/2625* (2013.01); *E06B 2009/2627* (2013.01)

(58) Field of Classification Search

CPC .. E06B 2009/2625; E06B 9/262; E06B 9/38; E06B 9/326; E06B 209/2622

See application file for complete search history.

(56) References Cited

U.S. PATENT DOCUMENTS

| | | | | |
|---|---|---|---|---|
| 2,295,137 A * | 9/1942 | Sutton | E06B 9/262 160/238 |
| 5,139,069 A * | 8/1992 | Hong | E06B 9/262 160/237 |
| 6,988,526 B2 * | 1/2006 | Judkins | E06B 9/262 160/84.01 |
| 8,079,397 B2 * | 12/2011 | Robertson | E06B 9/262 160/84.01 |
| 9,016,346 B2 * | 4/2015 | Cha | A47H 5/032 160/84.05 |
| 9,022,090 B2 * | 5/2015 | Cha | A47H 5/032 160/84.05 |
| 9,049,953 B2 * | 6/2015 | Cha | A47H 5/032 |
| 9,267,324 B2 * | 2/2016 | Strand | E06B 9/262 |
| 2012/0103538 A1 * | 5/2012 | Gleinser | E06B 9/262 160/84.04 |

FOREIGN PATENT DOCUMENTS

| | | | |
|---|---|---|---|
| KR | 10-1153854 B1 | 6/2012 | |
| WO | WO 2012109501 A1 * | 8/2012 | E06B 9/262 |

* cited by examiner

*Primary Examiner* — Katherine Mitchell
*Assistant Examiner* — Abe Massad

(57) ABSTRACT

Provided is a cord embedded roman shape, including: a first curtain 10; a second curtain 20; a connection belt 30 connecting the first curtain 10 to the second curtain 20; a cord 40 fixed to lower ends of the first curtain 10 and the second curtain 20 by passing through the connection belt 30; and a curtain adjusting member 50 adjusting the cord 40. Therefore, the cord embedded roman shade is integrally woven without separately forming the ring, thereby preventing the accidents that the cord is wound around the child's body.

17 Claims, 17 Drawing Sheets

CORD EMBEDDED ROMAN SHADE

TECHNICAL FIELD

The present invention relates to a cord embedded roman shade, and more particularly, to a cord embedded roman shade capable of minimizing a cord exposed to the outside.

BACKGROUND ART

In recent, as people consider functions and esthetic elements of a curtain to be important, a roman shade with a beautifully folded shape has become popular. Since the roman shade basically forms a plurality of layers as a curtain portion ascends while being folded, the roman shade has a beautiful appearance.

The roman shade according to the related art is disclosed in 'Patent Document (KR 10-1153854 B1, Jun. 18, 2012). Referring to FIGS. 1 and 2, the roman shade according to the related art is configured of a fabric 3, rings 4, and a cord 5. The fabric 3 is woven by intersecting warps 1 with wefts 2. Among them, some of the wefts 2 do not intersect the warps 1, and thus the rings 4 are formed. The warps 1 do not intersect some of the wefts 2 while the warps 1 intersect the wefts 2 by passing through between the wefts 2, such that the wefts 2 of a portion through which the warps 1 do not pass are collected to form the rings 4, and the cord 5 passes through the rings 4.

However, the roman shade according to the related art needs to separately form the rings 4 so as to connect the cord 5 to the fabric 3. To this end, some of the wefts 2 need not separately intersect the warps 1, which may lead to a complicated weaving process.

Further, since some of the wefts 2 do not intersect the warps 1 in order to form the ring 4, the durability of the corresponding portion may be weakened.

Further, the cord 5 is generally made of a transparent, thin, and hard material so as not to be seen well in the appearance even though the cord 5 is exposed to the outside. In this case, owing to the structure in which the cord 5 is exposed to the outside, accidents that the cord 5 is wound around a child's hand or neck while playing may occur.

Technical Problem

An object of the present invention is to provide a cord embedded roman shade which is integrally woven by including a connection belt.

Technical Solution

According to an exemplary embodiment of the present invention, there is provided a cord embedded roman shade including: a first curtain woven by intersecting first wefts with first warps; a second curtain woven by intersecting second wefts with second warps; a connection belt formed between the first curtain and the second curtain in a horizontal direction to connect the first curtain to the second curtain; a cord fixed to lower ends of the first curtain and the second curtain by passing through the connection belt; and a curtain adjusting member connected to one end of the cord to adjust the cord.

Advantageous Effects

According to the exemplary embodiments of the present invention, the cord embedded roman shade is integrally woven without separately forming the ring, thereby preventing accidents that the cord is wound around the child's body.

DESCRIPTION OF DRAWINGS

The above and other objects, features and advantages of the present invention will become apparent from the following description of preferred embodiments given in conjunction with the accompanying drawings, in which.

BEST MODE

Figure 1:
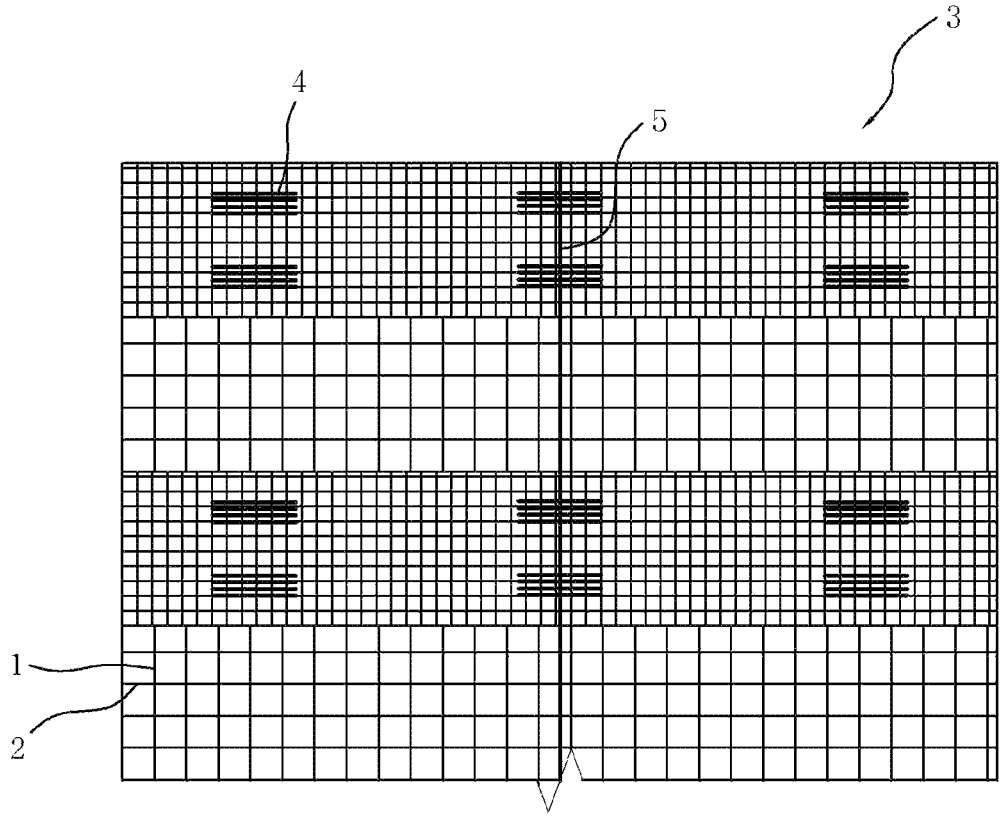
FIG. 1 is a front view illustrating a roman shade type blind according to the related art.
Figure 2:
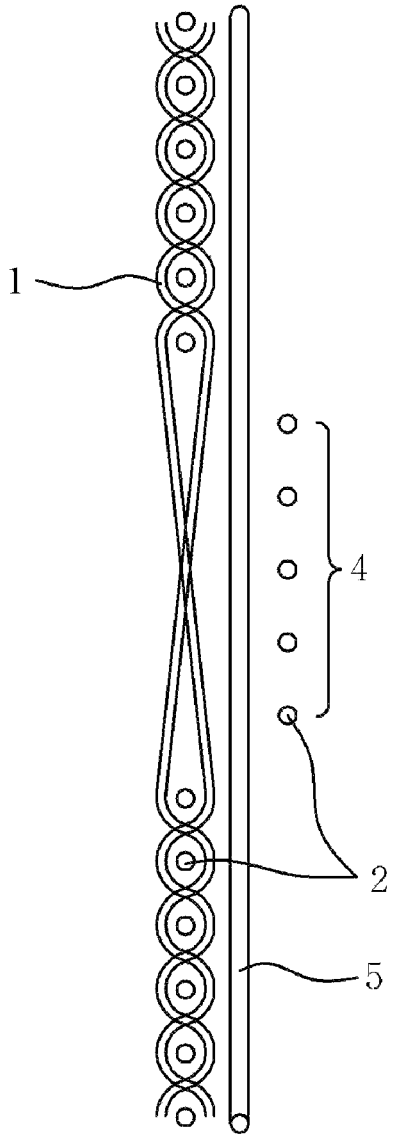
FIG. 2 is a partial side cross-sectional view illustrating the roman shade type blind according to the related art.

Hereinafter, a cord embedded roman shade according to the present invention will be described in more detail with reference to the accompanying drawings.

The present invention relates to a cord embedded roman shade, and as illustrated in FIGS. 3 to 7, the cord embedded roman shade is configured to include: a first curtain 10 which is woven by intersecting first wefts 12 with first warps 14; a second curtain 20 which is woven by intersecting second wefts 22 with second warps 24; connection belts 30 which connect the first curtain 10 to the second curtain 20; cords 40 which are fixed to lower ends of the first curtain 10 and the second curtain 20 by passing through the connection belt 30; and a curtain adjusting member 50 which is connected to one end of the cord 40.

The first curtain 10 is woven by intersecting the first wefts 12 with the first warps 14.

The second curtain 20 is disposed to face the first curtain 10 and is woven by intersecting the second wefts 22 with the second warps 24.

If necessary, the lower ends of the first curtain 10 and the second curtain 20 are further provided with weighters 16 having a predetermined weight, such that the first curtain 10 and the second curtain 20 may be applied with gravity to be stably mounted while less swaying against an external shock.

The connection belt 30 is formed between the first curtain 10 and the second curtain 20 in a horizontal direction to serve to connect the first curtain 10 to the second curtain 20. Further, the connection belt 30 is not formed using a separate yarn, but is formed by intersecting the first and second wefts 12 and 22 with the first and second warps 14 and 24 and has the cord 40 to be described below passing therethrough. Therefore, the cord embedded roman shade according to the exemplary embodiment of the present invention is integrally woven without forming a separate ring and has a curtain formed in a double type to form double-sided wrinkles, such that it may have a beautiful appearance and may be conveniently mounted without dividing a direction at the time of being mounted at a window, and the like.

Hereinafter, the first curtain 10 and the second curtain 20 according to the exemplary embodiment of the present invention will be described.

Figure 4:
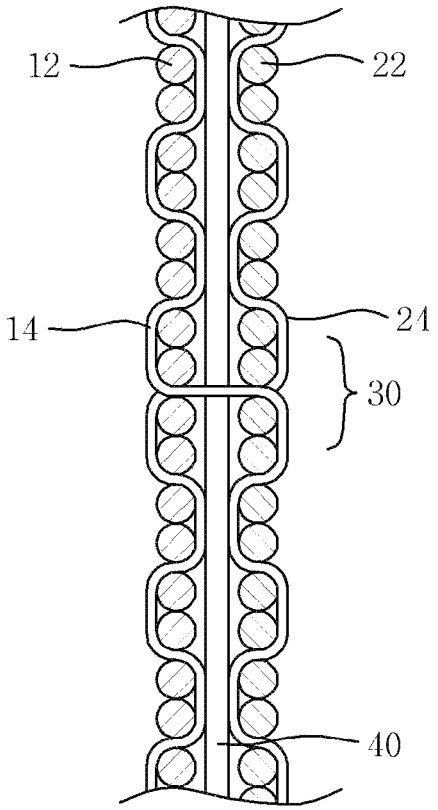
FIG. 4 is a cross-sectional view of first and second curtains according to a first exemplary embodiment of the present invention taken along the line A-A' of FIG. 3.

According to a first exemplary embodiment of the present invention, as illustrated in FIG. 4, the first warp 14 descends while intersecting the first weft 12 up to a predetermined section and then moves to a position of the second warp 24 to intersect the second weft 22. By the same method, the second warp 24 descends while intersecting the second weft 22 and then intersects the first weft 12 at a position at which the first warp 14 intersects the second weft 22. Therefore, the first curtain 10 and the second curtain 20 are connected to each other by exchanging the warps and the portion at which the first warp 14 intersects the second warp 24 is the connection belt 30.

In the case of the first exemplary embodiment of the present invention, even though thicknesses of yarns of the first warp 14 and the second warp 24 or the first weft 12 and the second weft 22 each differ from each other, the curtain may be woven without being bent in one direction. That is, when the curtain is woven by each yarn in the state in which the thickness of a yarn used for the first curtain 10 and the thickness of a yarn used for the second curtain 20 differ from each other, the sizes of the first curtain 10 and the second curtain 20 differ from each other, and therefore the first exemplary embodiment of the present invention may solve the above-mentioned problem by intersecting the yarn in the middle.

Figure 5:
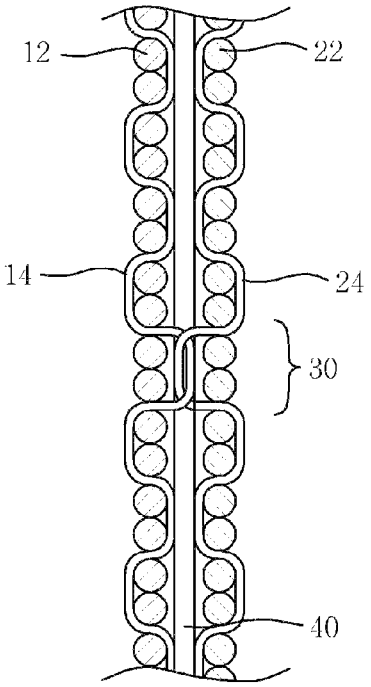
FIG. 5 is a cross-sectional view of first and second curtains according to a second exemplary embodiment of the present invention taken along the line A-A' of FIG. 3.

As illustrated in FIG. 5, according to a second exemplary embodiment of the present invention, after the first warp 14 descends while intersecting the first weft 12 and the second warp 24 descends while intersecting the second weft 22, the first warp 14 and the second warp 24 are twisted at a predetermined position. Then, the first warp 14 intersects the first weft 12 and the second warp 24 intersects the second weft 22.

Therefore, the first curtain 10 and the second curtain 20 are connected to each other by twisting the warps and the portion at which the first warp 14 and the second warp 24 are twisted is the connection belt 30.

Figure 6:
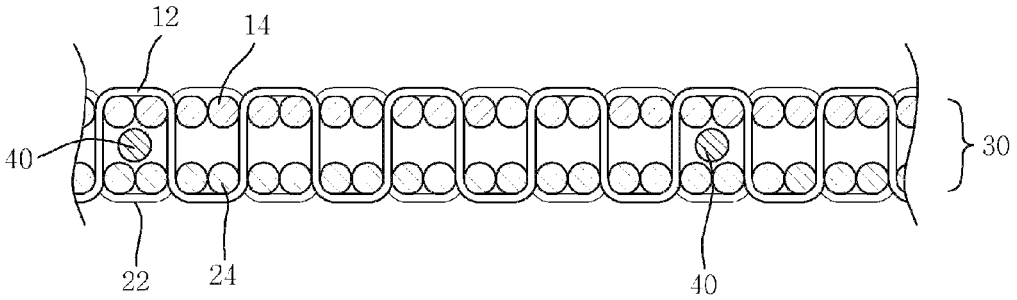
FIG. 6 is a cross-sectional view of first and second curtains according to a third exemplary embodiment of the present invention taken along the line B-B' of FIG. 3.

As illustrated in FIG. 6, according to a third exemplary embodiment of the present invention, the first weft 12 intersects the first and second warps 14 and 24 and the second weft 22 intersects the second and first warps 24 and 14. That is, the first and second warps 14 and 24 intersect each other in the form in which the first weft 12 and the second weft 22 intersect each other and the portion at which the first weft 12 and the second weft 22 intersect each other is the connection belt 30. Unlike the first and second exemplary embodiments of the present invention, according to the third exemplary embodiment of the present invention, since the connection belt 30 is formed by intersecting the wefts, the thickness of the connection belt 30 may be adjusted by increasing the number of intersecting wefts. Therefore, the first curtain 10 may be further firmly connected to the second curtain 20 and the wrinkle form of the cord embedded roman shade according to the exemplary embodiment of the present invention may be variously adjusted.

As described above, the connection belt 30 may be formed by various methods and if necessary, the plurality of connection belts 30 may be formed in the vertical direction to increase the number of wrinkles of the cord embedded roman shade according to the exemplary embodiment of the present invention.

One end of the cord 40 is fixed to a rotating bar 52 to be described below and the other end thereof passes through the connection belt 30 and then fixed to lower ends of the first curtain 10 and the second curtain 20 to be wound or unwound by the rotation of the rotating bar 52, such that the first curtain 10 and the second curtain 20 may be folded or unfolded.

Since the cord 40 is disposed between the first curtain 10 and the second curtain 20 so as not to be exposed to the outside, it is possible to prevent accidents that the cord 5 is wound around a child's body while playing or the operation of the roman shade. Since the roman shade according to the related art has a structure in which the cord 40 is exposed to the outside, the cord 40 is made of a transparent, thin, and hard material so as not to expose the cord 40 in appearance, such that the adult and the child may not easily recognize the exposed cord 40, thereby causing the frequent occurrence of accidents; to the contrary, since the cord embedded roman shade according to the exemplary embodiment of the present invention has a structure in which the cord is not exposed to the outside, the cord 40 is made of an opaque material, such that the cord 40 may be easily recognized even though the cord 40 is exposed to the outside.

Figure 7:
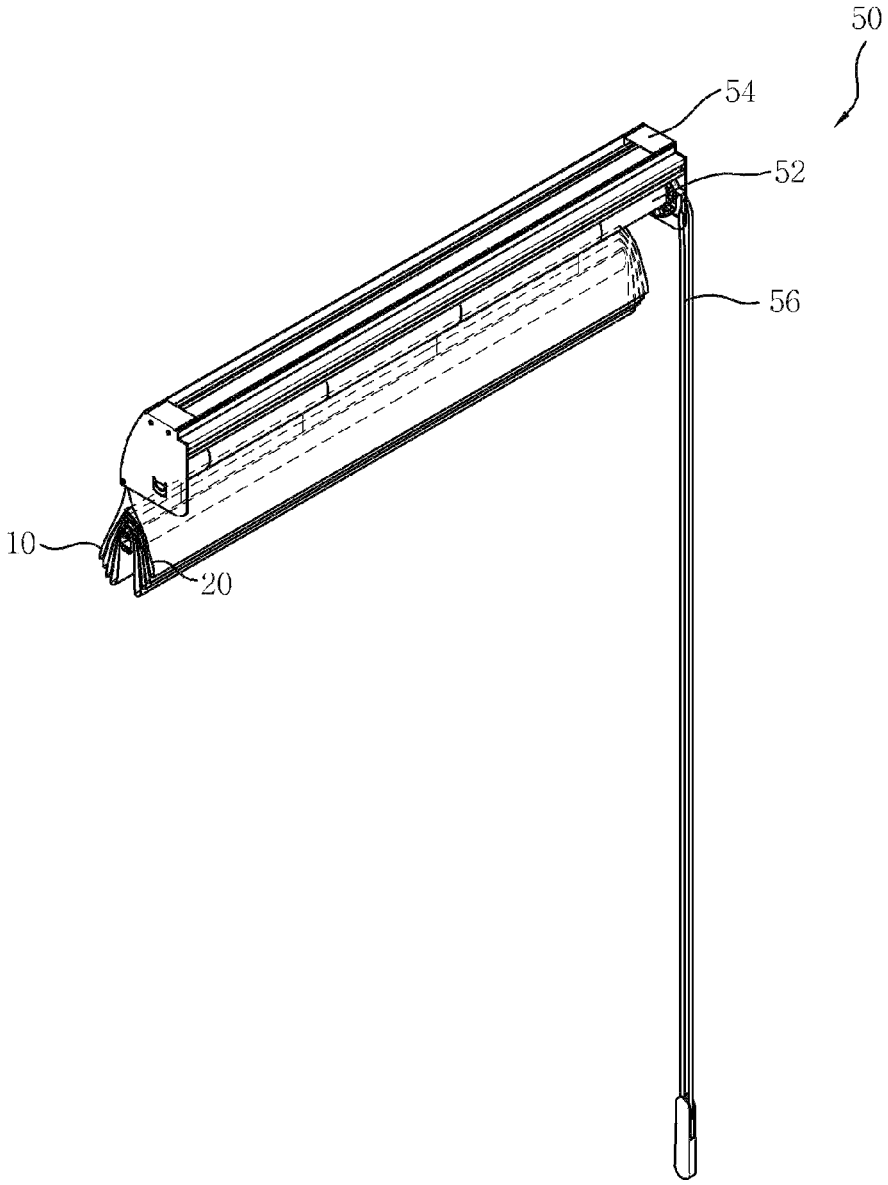
FIG. 7 is a perspective view illustrating an operating state of the cord embedded roman shade according to the exemplary embodiment of the present invention.

Therefore, when the cord 40 is wound around the rotating bar 52 to be described below, the first curtain 10 and the second curtain 20 begin to ascend from the lower ends thereof. In this case, when the lower ends of the first curtain 10 and the second curtain 20 overlap the connection belt 30, the first curtain 10 and the second curtain 20 are formed with wrinkles and when the cord 40 is completely wound around the rotating bar 52, the wrinkles are formed as many as the number of connection belts 30 as illustrated in FIG. 7.

Figure 8A:
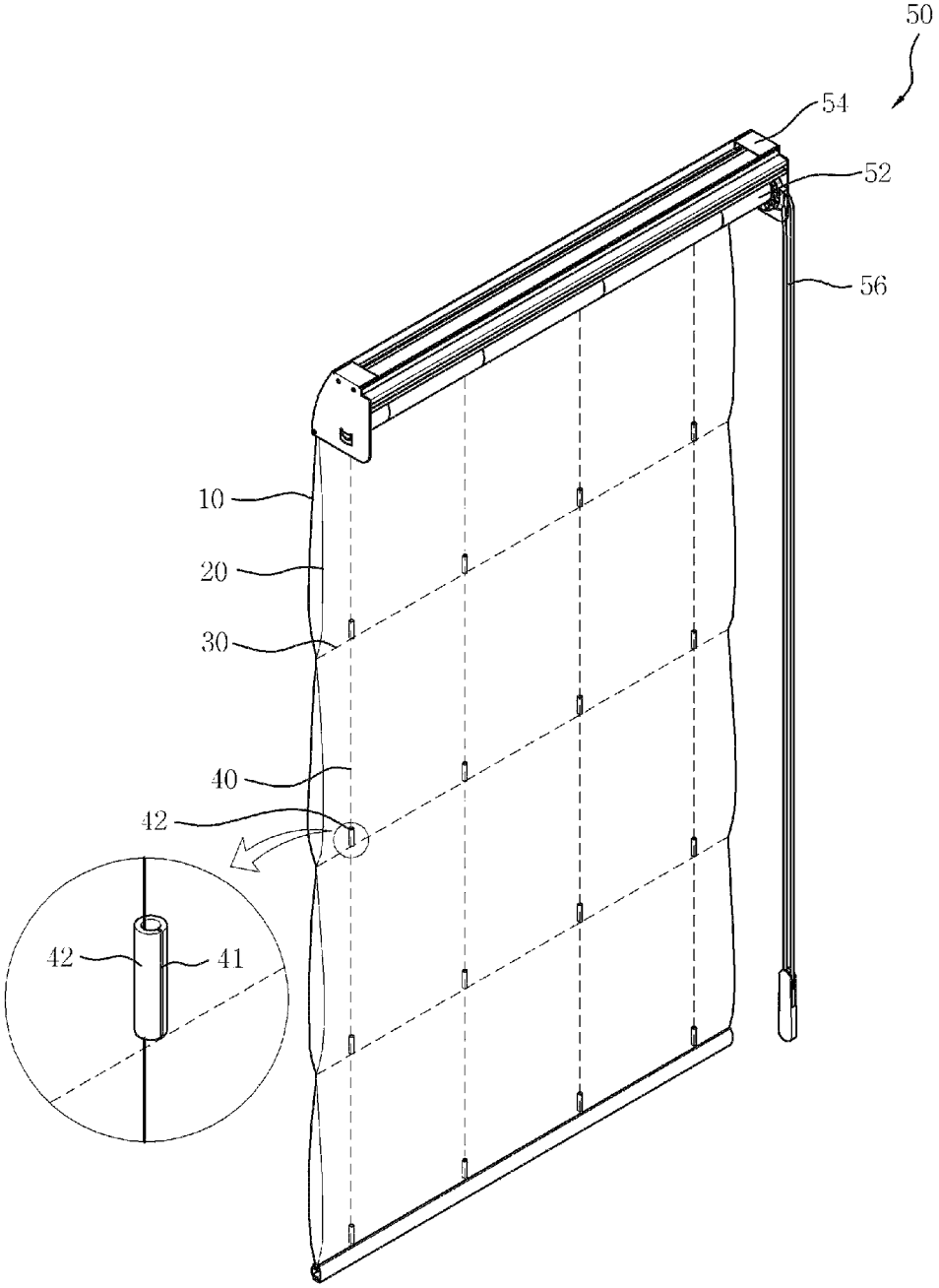
FIGS. 8*a* and 8*b* are perspective views illustrating a gap holding member according to an exemplary embodiment of the present invention.
Figure 8B:
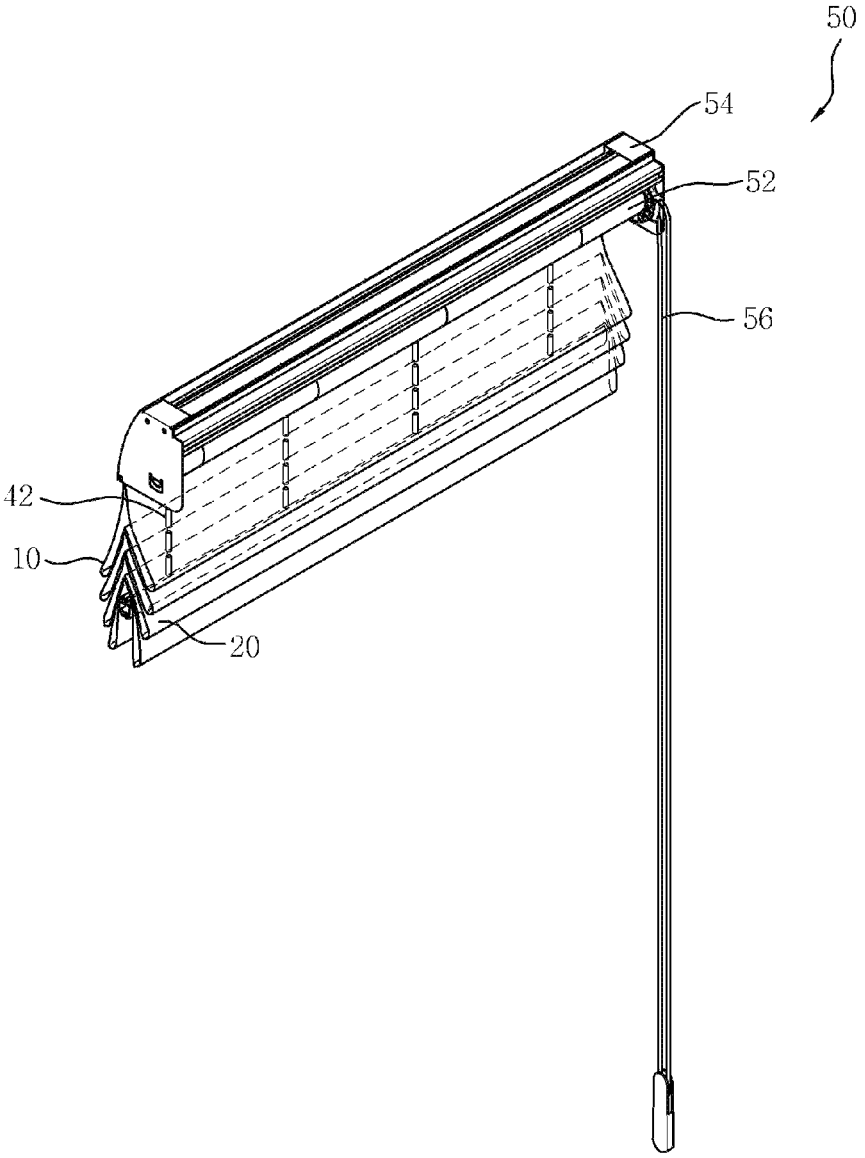

The gap holding member 42, which has a pipe shape as illustrated in FIG. 8A, is mounted on the cord 40 and if necessary, a side thereof is provided with a slit 41 to be easily mounted. When wrinkles are formed, the gap holding member 42 is disposed between the connection belts 30 to make the gap between the connection belts 30 constant and as illustrated in FIG. 8B, when the first curtain 10 and the second curtain 20 are folded, the wrinkles are formed at a predetermined gap (height of the gap holding member 42).

Figure 9:
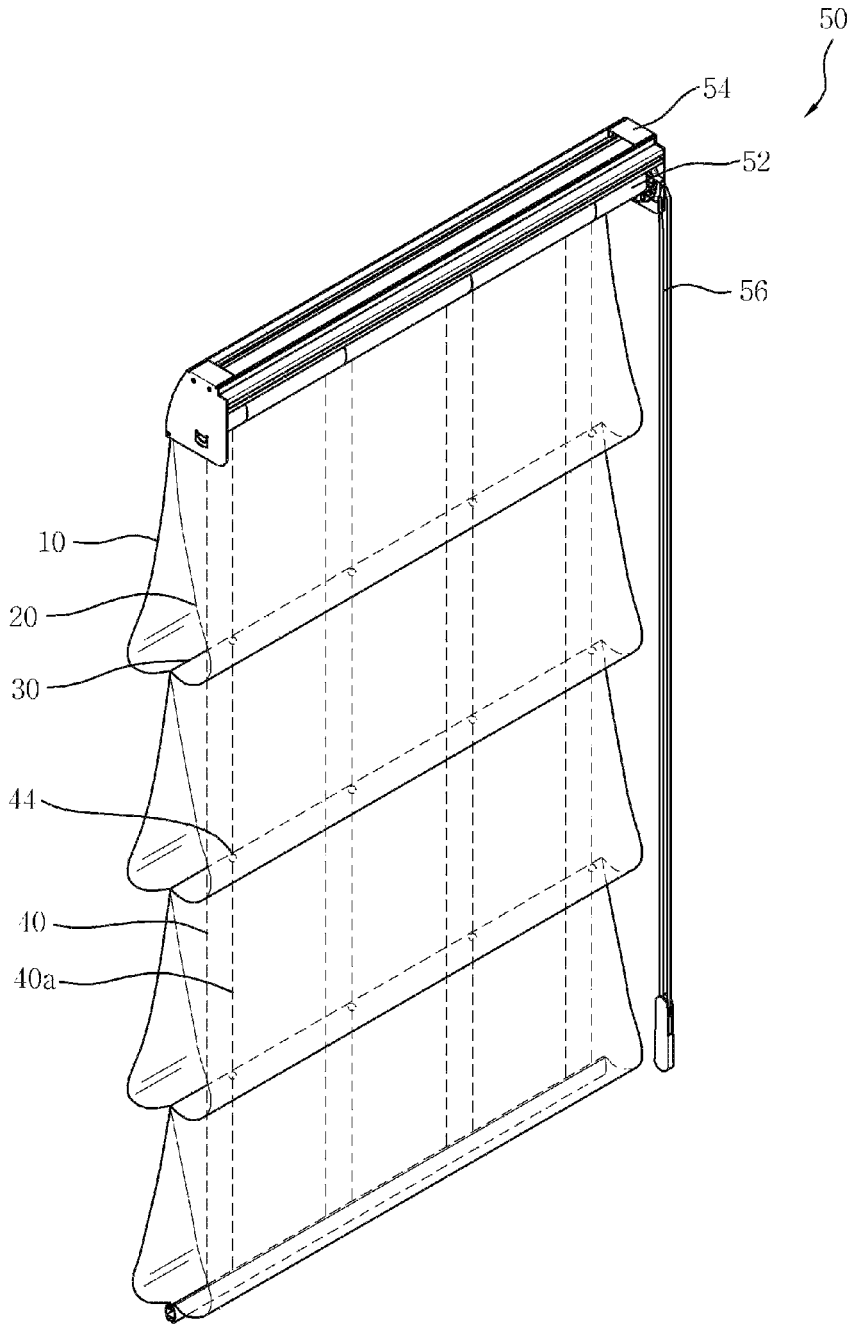
FIG. 9 is a perspective view illustrating a fixed bead according to an exemplary embodiment of the present invention.

A fixed bead 44 is a bead formed with a through hole and as illustrated in FIG. 9, is fixed on auxiliary cords 40*a* fixed to the lower and upper ends of the first curtain 10 and the second curtain 20, such that when the curtains are unfolded, the fixed bead 44 is locked to the connection belt 30 and thus the curtains are no more unfolded, and the wrinkles are formed. For reference, separately from the cord 40, the auxiliary cord 40*a* has one end and the other end each fixed to the upper and lower ends to each of the first and second curtains 10 and 20 and the fixed bead 44 fixed on the auxiliary cord 40*a* is locked to the connection belt 30 at the middle thereof by passing through the connection belt 30.

Meanwhile, the cord embedded roman shade according to the exemplary embodiment of the present invention formed with the fixed bead 44 may be further provided with the gap holding member 42. In this case, when the curtain is unfolded, the curtain is not completely unfolded by the fixed bead 44 and therefore is layered and to the contrary, when the curtain is folded, the curtain is layered at a predetermined gap by the gap holding member 42.

The curtain adjusting member 50 is connected to the other end of the cord 40 to serve to adjust the cord 40. The curtain adjusting member 50 is configured to include the rotating bar 52 to which one end of the cord 40 is fixed; a frame 54 having both ends inside thereof which are connected to rotating shafts of both ends of the rotating bar 52 and fixed to which the upper ends of the first and second curtains 10 and 20 are fixed; and a tow rope 56 adjusting the rotation of the rotating bar 52.

The rotating bar 52, which is a rotating component in order to operate the cord embedded roman shade according to the exemplary embodiment of the present invention, has the rotating shaft connected to a frame 54 to be described below. Further, the rotating bar 52 is connected to one end of the cord 40, and thus the cord 40 is wound or unwound by the rotation of the rotating bar 52.

Figure 3:
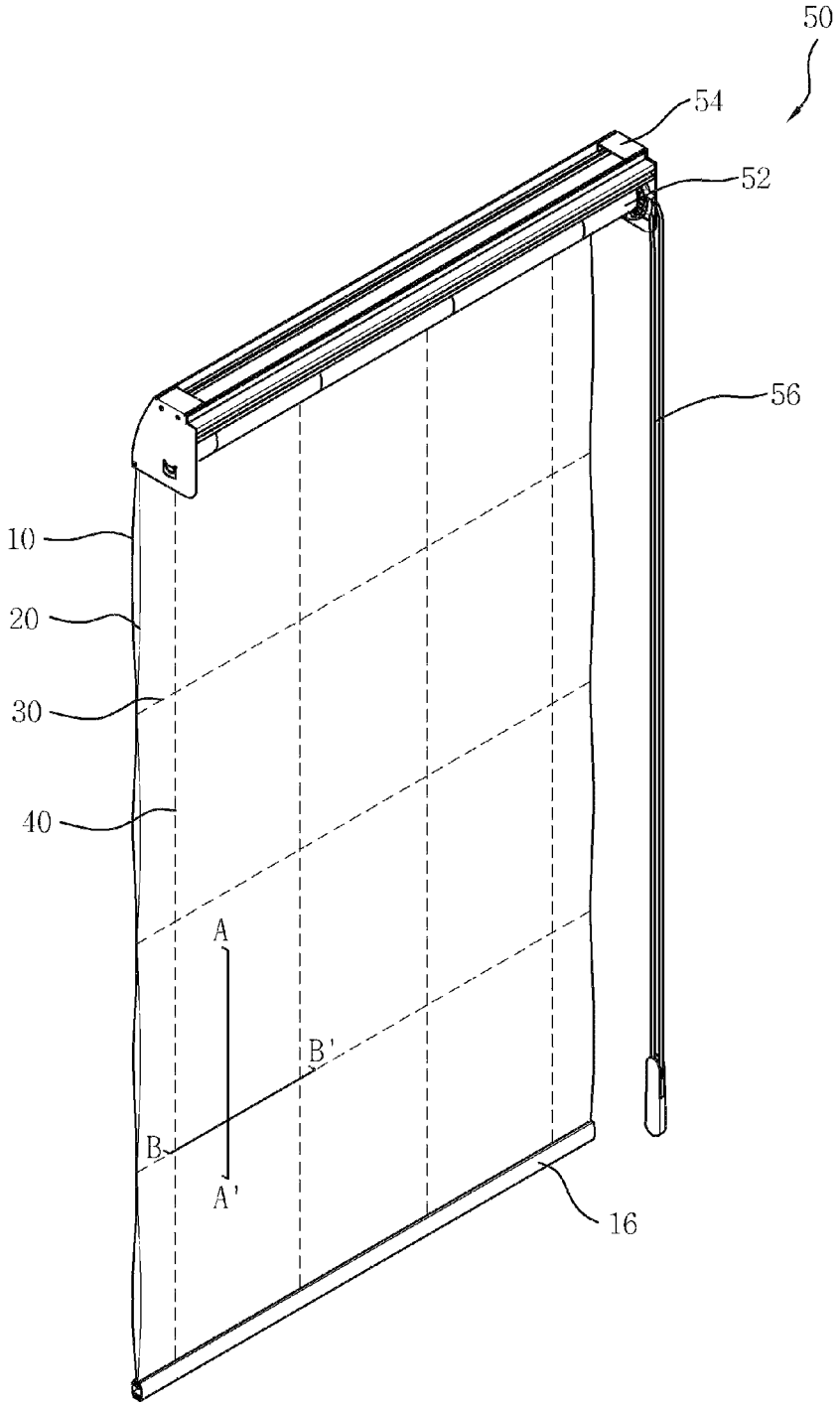
FIG. 3 is a perspective view illustrating a cord embedded roman shade according to an exemplary embodiment of the present invention.

As illustrated in FIG. 3, the frame 54 has both ends inside thereof connected to the rotating shafts of both ends of the rotating bar 52 to perform a rotating motion with respect to the frame 54 and the upper ends of the first and second curtains 10 and 20 are fixed to the frame 54. Further, the frame 54 is attached at a position at which the cord embedded roman shade according to the exemplary embodiment of the present invention is mounted.

The tow rope 56 is wound around one end of the rotating bar 52 to serve to adjust the rotation of the rotating bar 52.

Hereinafter, the case in which the third curtain 60 is added to the cord embedded roman shade according to the exemplary embodiment of the present invention will be described.

Figure 10:
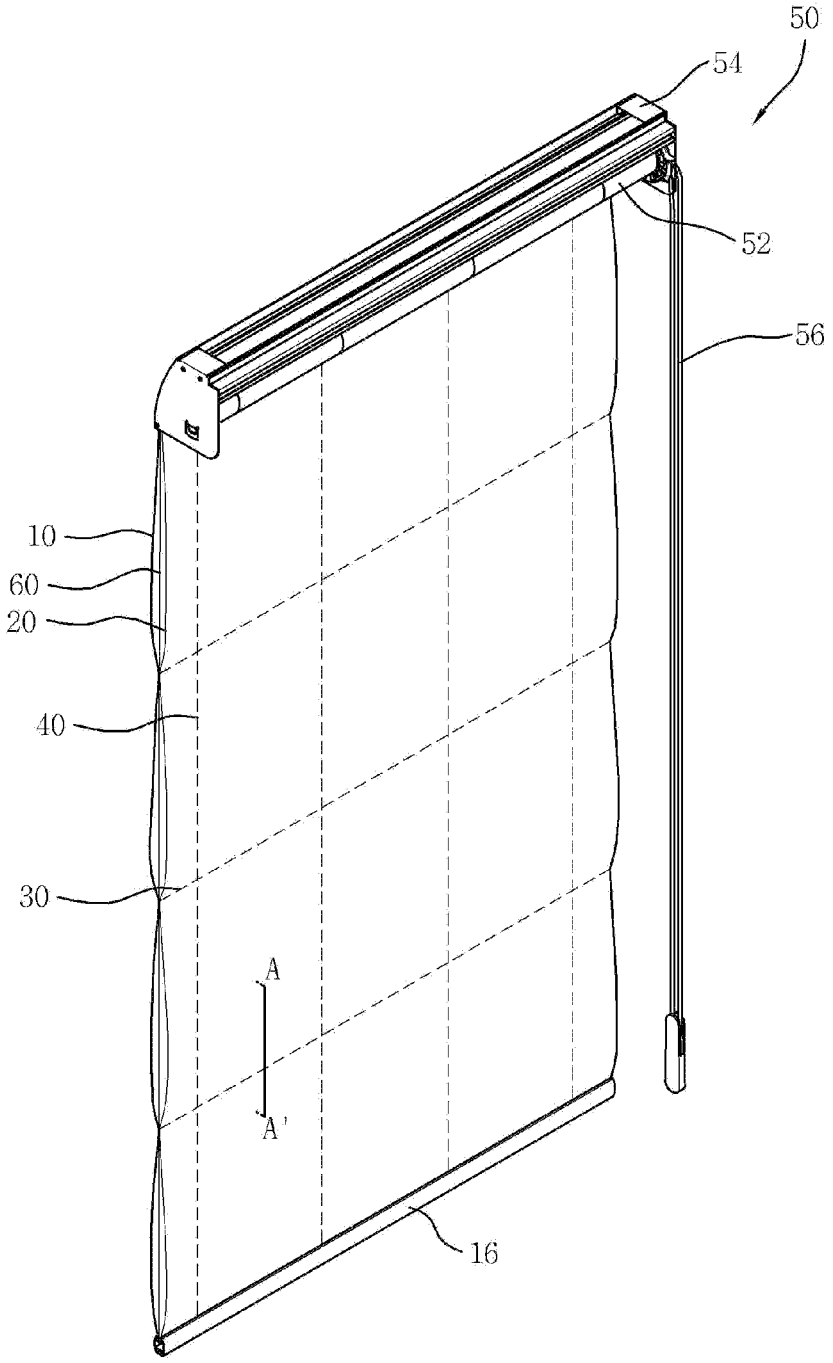
FIG. 10 is a perspective view illustrating that a third curtain according to a third exemplary embodiment of the present invention is provided.
Figure 11:
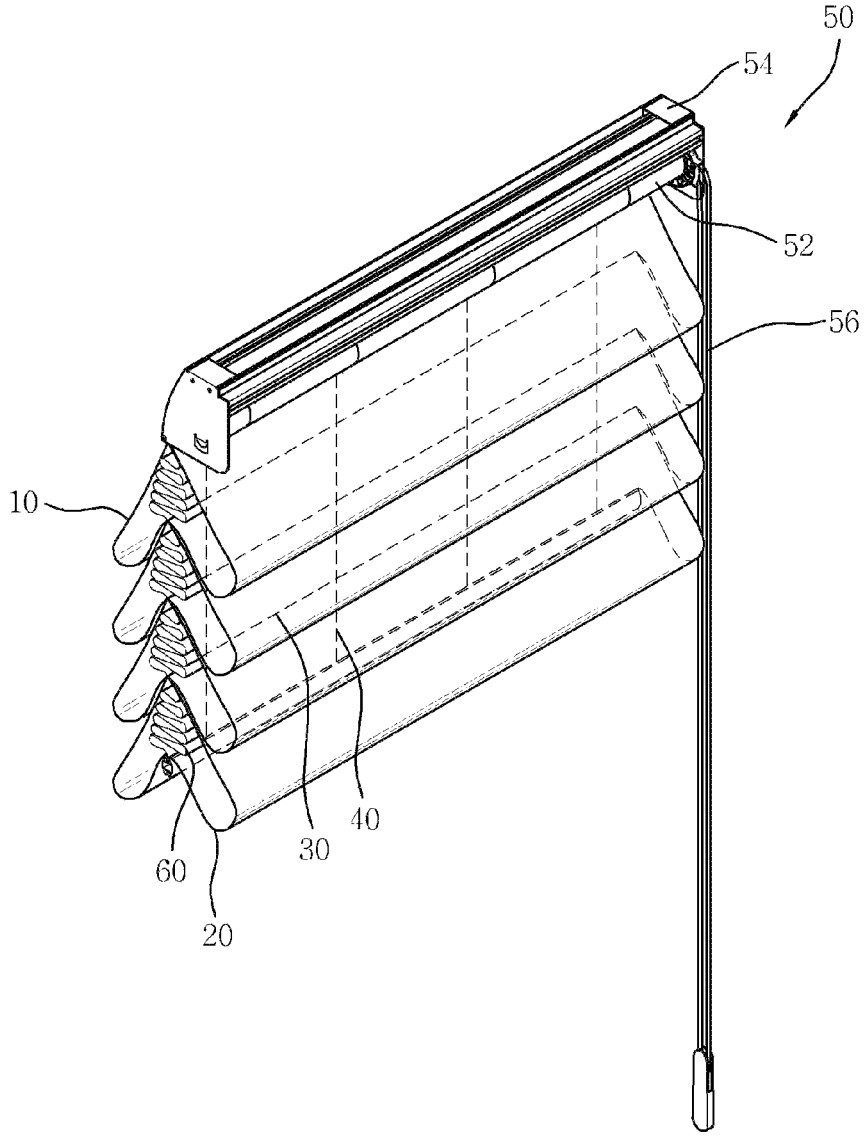
FIG. 11 is a perspective view illustrating the operating state of FIG. 10.
Figure 12:
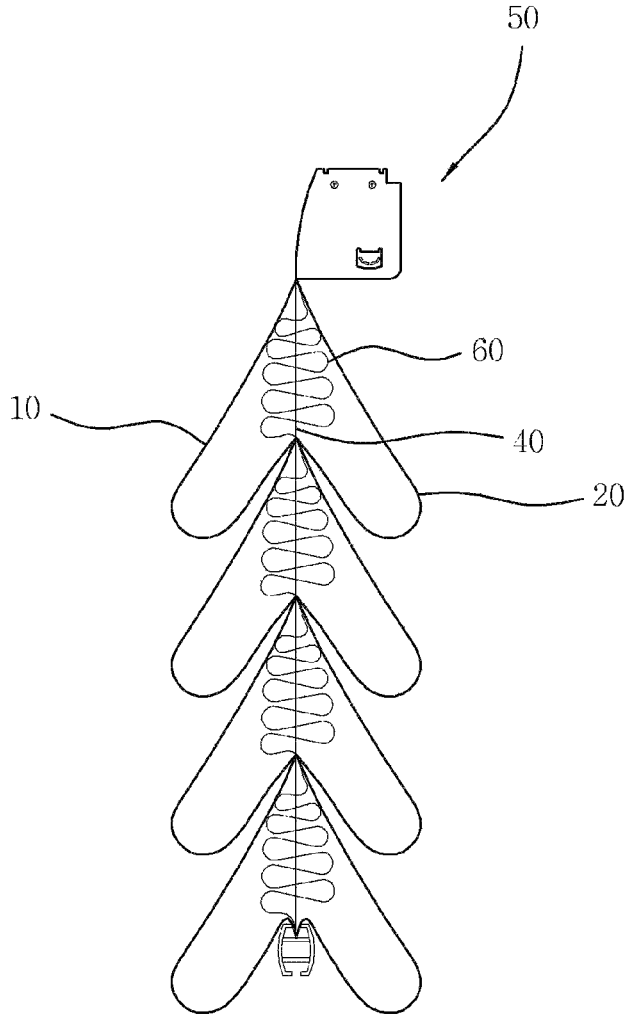
FIG. 12 is a side view of FIG. 11.

The third curtain 60 is woven by intersecting third wefts 62 with third warps 64 and as illustrated in FIG. 10, is an additional component which is disposed between the first curtain 10 and the second curtain 20. In this case, the cord 40 partially passes through (passing like broad stitching in sewing) the third curtain 60 repeatedly while vertically descending from the third curtain 60 and passes through the connection belt 30 in the middle thereof and then is fixed to the lower ends of the first, second, and third curtains 10, 20, and 60. Therefore, when the cord embedded roman shade according to the exemplary embodiment of the present invention is folded, the third curtain 60 is formed with wrinkles at regular as illustrated in FIG. 11. As described above, the reason why the cord 40 repeatedly passes through the third curtain 60 is to shorten an exposed length of the cord 40 which may wind a portion of a child's body. Since the cord 40 is disposed between the first curtain 10 and the second curtain 20 so as not to be exposed to the outside, it seems that there is no risk that the cord 40 is wound around or caught in children, but when the roman shade is folded, a space between the first curtain 10 and the second curtain 20 is expanded, such that when viewing from the side, the cord 40 disposed between the first curtain 10 and the second curtain 20 may be easily found. Further, even when the roman shade is unfolded, children open between the first curtain 10 and the second curtain 20 in case of being curious would likely expose the cord 40. The third curtain 60 is to solve the above problem, and as illustrated in FIG. 12, the cord 40 repeatedly passes through the third curtain 60 repeatedly, such that the exposed length of the cord which may wind a portion of the child body by using the cord 40 is shortened. Further, if necessary, a pattern of the cord passing through the third weft 63 is dense, such that the exposed length of the cord 40 may be shorter.

Figure 13:
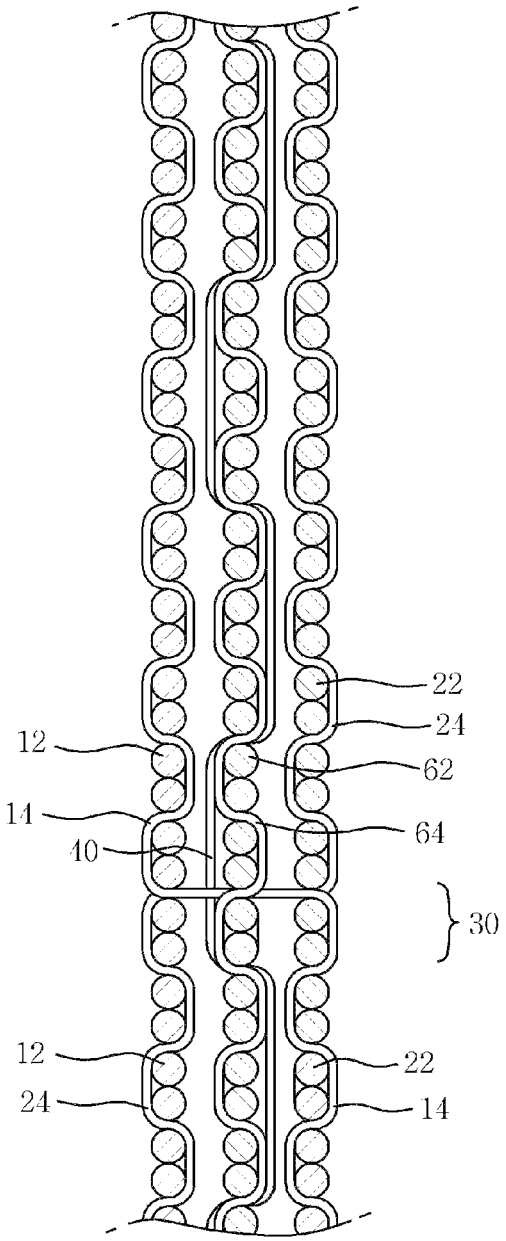
FIG. 13 is a cross-sectional view of the first and second curtains according to the first exemplary embodiment of the present invention taken along the line A-A' of FIG. 10.

According to the first curtain 10 and the second curtain 20 according to the first exemplary embodiment of the present invention when the third curtain 60 is formed, as illustrated in FIG. 13, the first warp 14 descends while intersecting the first weft 12 and then intersects the second weft 22. By the same method, the second warp 24 descends while intersecting the second weft 22 and then intersects the first weft 12 at a position at which the first warp 14 intersects the second weft 22. In this case, the cord 40 repeatedly passes between the third wefts 62 to be connected to the third curtain 60.

Figure 14:
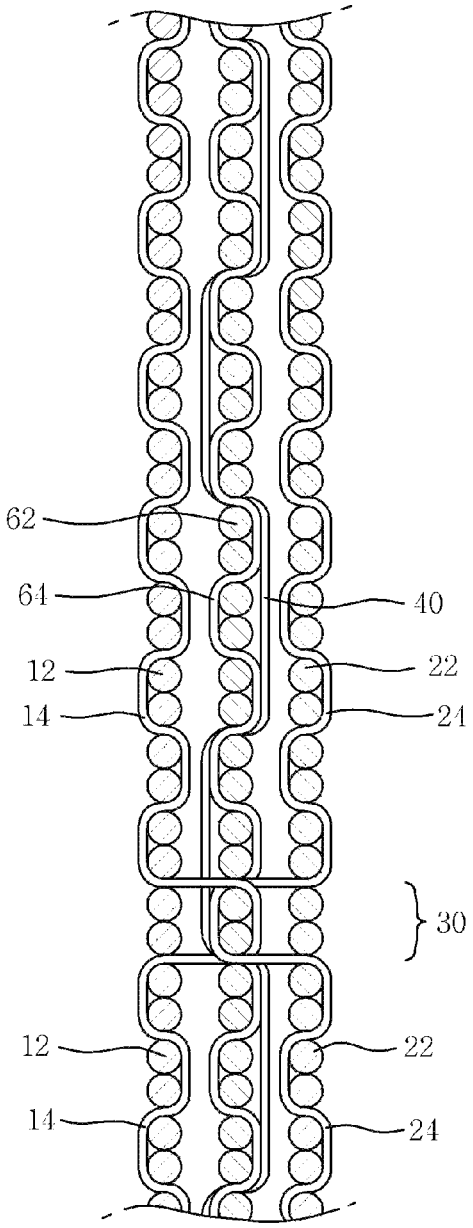
FIG. 14 is a cross-sectional view of the first and second curtains according to the second exemplary embodiment of the present invention taken along the line A-A' of FIG. 10.

As illustrated in FIG. 14, according to a second exemplary embodiment of the present invention, after the first warp 14 descends while intersecting the first weft 12 and the second warp 24 descends while intersecting the second weft 22, the first warp 14 and the second warp 24 are twisted at a predetermined position. Then, the first warp 14 intersects the first weft 12 and the second warp 24 intersects the second weft 22.

Meanwhile, the cord embedded roman shade according to the exemplary embodiment of the present invention may be further provided with a female holder 70 and a male holder by which the cord 40 is fixed to the curtain, the contents of which will be described below.

The female holder 70 is connected to the lower ends of the first and second curtains 10 and 20 and is provided with one end of the cord 40 and fixes the cord 40 by engaging with the male holder 80 to be described below.

Figure 15:
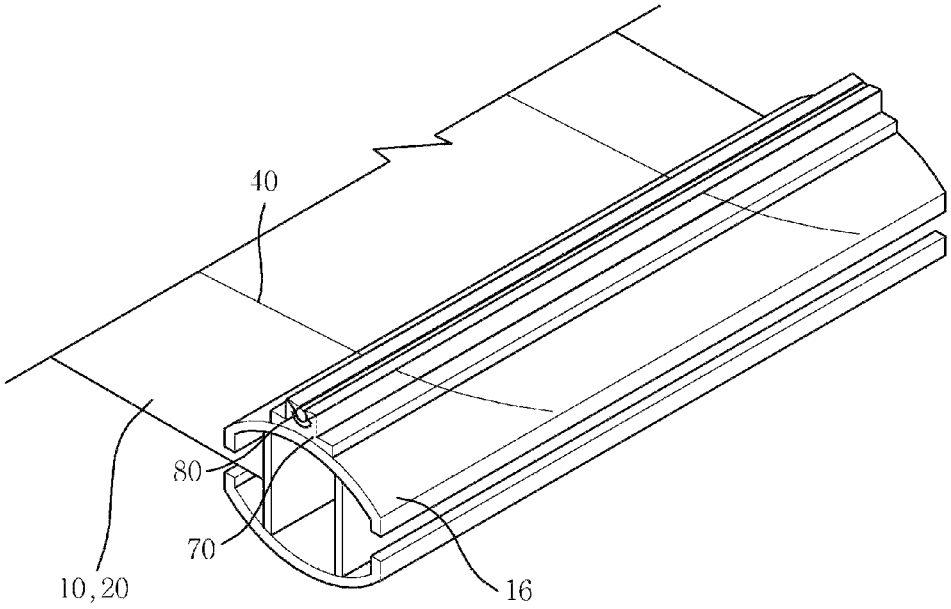
FIG. 15 is a perspective view illustrating a female holder and a male holder according to an exemplary embodiment of the present invention.
Figure 16:
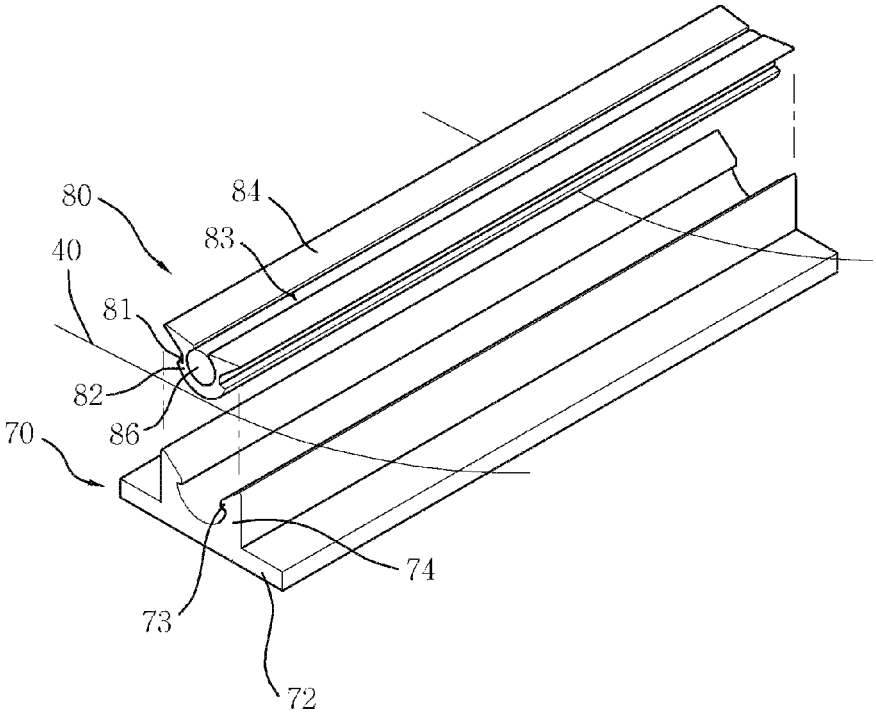
FIG. 16 is an exploded perspective view illustrating the female holder and the male holder according to the exemplary embodiment of the present invention.

As illustrated in FIG. 15, the female holder 70 has a bar shape having the opened one side and an inside thereof is provided with one end of the cord 40. Referring to FIG. 16, the female holder 70 is configured to include a female holder body 72 and a pair of receiving protrusions 74 which are mounted at an outer circumferential surface of the female holder body 72 in parallel.

Figure 17:
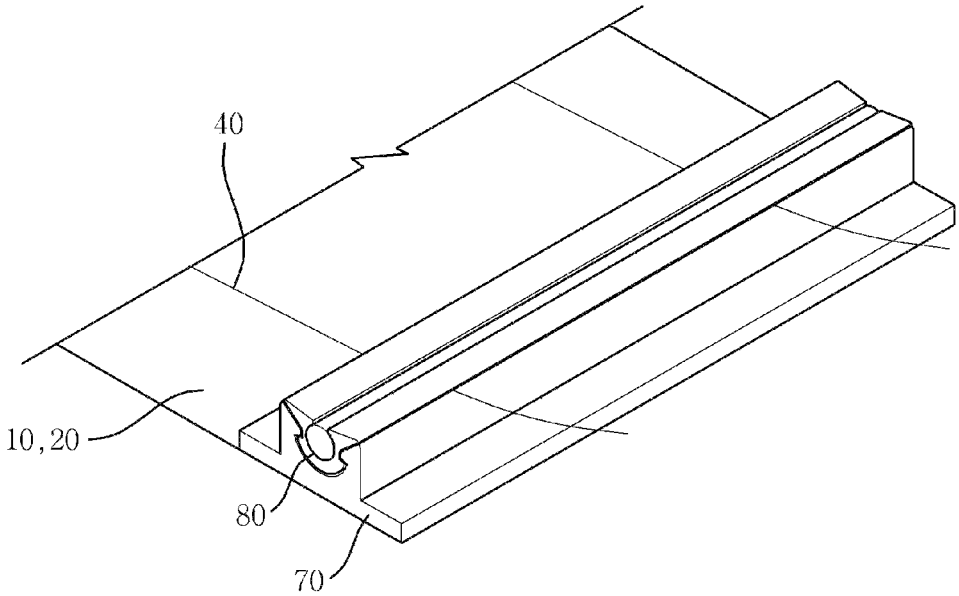
FIG. 17 is a diagram illustrating a mounting state of the female holder and the male holder according to the exemplary embodiment of the present invention.

The female holder body 72 has a plate shape and is connected to the lower ends of the first and second curtains 10 and 20. As illustrated in FIG. 15, the female holder body 72 may be connected to the weighter 16 which holds the shape of the first and second curtains 10 and 20 and if necessary, as illustrated in FIG. 17, the female holder body 72 is directly connected to the first and second curtains 10 and 20 to hold a predetermined weight to fix the cord 40 while serving as the weighter 16.

The receiving protrusion 74 is provided in pair and is mounted on one side of the female holder body 72 in parallel. The receiving protrusion 74 is a component which connects the male holder 80 to the female holder 70 according to the exemplary embodiment of the present invention and is mounted to hold a predetermined gap to receive a coupling protrusion 82 to be described below. Further, as illustrated in FIG. 16, an inside of the receiving protrusion 74 is formed to match a shape of the male holder 80 to be described below.

Insides of inlets of the pair of receiving protrusions 74 are each provided with locking projections 73 so as to prevent the male holder 80 from separating from the female holder 70 after the male holder 80 to be described below is fitted in the female holder 70, thereby stably engaging the male holder 80 with the female holder 70. In this case, a side end at which the locking projection 73 of the receiving protrusion 74 is formed is formed to be inclined, such that the male holder 80 may be naturally engaged with the female holder 70 when the male holder 80 is engaged with the female holder 70. In detail, the end is formed to be expanded toward outside from inside of the inlet, such that the receiving protrusion 74 is naturally expanded when the male holder 80 is fitted in the female holder 70.

Meanwhile, the end of the female holder 70 has an opened form, which serves as a passage through which the male holder 80 may be separated from the female holder 70. That is, the male holder 80 fitted in the female holder 70 slides in the female holder 70 and is separated through the opened end of the female holder 70. As such, the reason why the end of the female holder 70 is formed in the opened form to allow the male holder 80 to slide in the female holder 70 is associated with the locking protrusion 73 which is formed at the inner side of the inlet of the receiving protrusion 74. That is, as illustrated in FIG. 19C, when the male holder 80 is fitted in the female holder 70, it is difficult to separate the male holder 80 in a reverse order to the fitted order due to the locking protrusion 73. In this case, the end of the female holder 70 is opened to make the male holder 80 slide, such that the male holder 80 may be separated from the female holder 70. In terms of the characteristics of the female holder and the male holder 80 according to the exemplary embodiment of the present invention, the reason why the cord 40 has a detachable structure is to easily separate the male holder 80 from the female holder 70, thereby facilitating the remounting of the cord 40 even when the cord 40 is separated.

The male holder 80 is fitted in an opening of the female holder 70 to serve to press the cord 40. That is, the cord 40 is fixed between the female holder 70 and the male holder 80 by a friction force. In this case, when a force pulling the cord 40 from the outside is larger than a maximum static friction force applied between the female holder 70 and the male holder 80, the cord 40 is separated from the female holder 70 and the male holder 80. Therefore, in the case in which the cord 40 is wound around a portion of the child's body while playing, when the cord 40 is pulled with a force above a predetermined strength, the cord 40 is separated from the female holder 70 and the male holder 80 according to the exemplary embodiment of the present invention to prevent sudden accidents.

Figure 18:
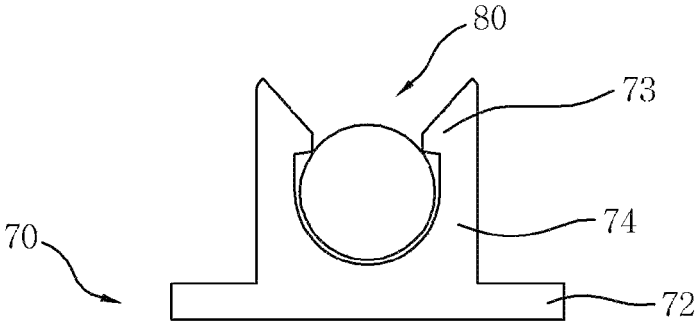
FIG. 18 is a diagram illustrating the male holder according to the embodiment of the present invention.

As illustrated in FIG. 16, the male holder 80 is configured to include a coupling protrusion 82 which is fitted in the receiving protrusion 74 and a pair of wings 84 which is mounted at a back of the coupling protrusion 82 in parallel to be locked to the end of the receiving protrusion 74. Further, as illustrated in FIG. 18, the male holder 80 is formed to have a bar shape of which the cross section is a circle to be fitted in the female holder 70.

The coupling protrusion 82 is a component which is fitted in the receiving protrusion 74 to press the cord 40, and preferably, is formed at the same thickness as a gap of the receiving protrusion 74 to press the cord 40. Further, if necessary, the friction force with the cord 40 may be adjusted by adjusting the thickness of the coupling protrusion 82. For example, when the cord 40 is thin, the friction force applied to the cord 40 is reduced, such that the cord 40 may be separated from a cord holder. In this case, the coupling protrusion 82 increases a force applying the receiving protrusion 74 by increasing the thickness of the coupling protrusion 82, thereby preventing the cord 40 from easily separating.

Further, both sides of the coupling protrusion 82 are provided with locking grooves 81, in which the locking groove 81 is locked to the locking protrusion 73 formed inside of the receiving protrusion 74. Therefore, the male holder 80 is fitted in the female holder 70 to be able to more firmly support the cord 40.

A cutting slit 83 is formed outside of the coupling protrusion 82 in a longitudinal direction, such that when the coupling protrusion 82 is fitted in the receiving protrusion 74, the coupling protrusion may easily pass through the locking protrusion 73 formed at the receiving protrusion 74. That is, when the coupling protrusion 82 passes through the locking protrusion 73, the coupling protrusion 82 is bent due to a space which is formed therein due to the cutting slit 83, such that the coupling protrusion 82 may easily pass through the locking protrusion 73 which is narrower than the thickness of the coupling protrusion 82.

The wings 84 are mounted at a back side of the coupling protrusion 82 in parallel with each other to contact the end of the receiving protrusion 74 when the coupling protrusion 82 is fitted in the receiving protrusion 74, such that the wings 84 may serve to press the cord 40 which is mounted therebetween. In order for the wing 84 to efficiently press the cord 40, an angle of the wing 84 mounted at the coupling protrusion 82 is changed depending on the shape of the end of the receiving protrusion 74. As illustrated in FIG. 16, when the end of the receiving protrusion 74 is formed to be inclined, the wing 84 is mounted at the coupling protrusion 82 at the above-mentioned angle to adhere to the end of the receiving protrusion 74. Further, the wing 84 prevents the coupling protrusion 82 from being excessively inserted into the female holder 70 to serve to easily separate the male holder 80 from the female holder 70 when the male holder 80 is separated form the female holder 70.

A shape holding member 86 is mounted in the cutting slit 83 to restore the shape of the coupling protrusion 82 which is folded while passing through the locking protrusions 73 and prevent durability from reducing. Further, if necessary, the friction force between the coupling protrusion 82 and the cord 40 may be adjusted by controlling the thickness of the shape holding member 86. When the shape holding member 86 larger than the inner space of the cutting slit 83 is used, the coupling protrusion 82 is thick to increase the pressing force of the coupling protrusion 82 to the receiving protrusion, such that the cord 40 may be more firmly fixed. Further, the shape holding member 86 is preferably made of an elastic material such as rubber.

Hereinafter, the fitting process of the female holder 70 and the male holder 80 will be described.

Figure 19A:
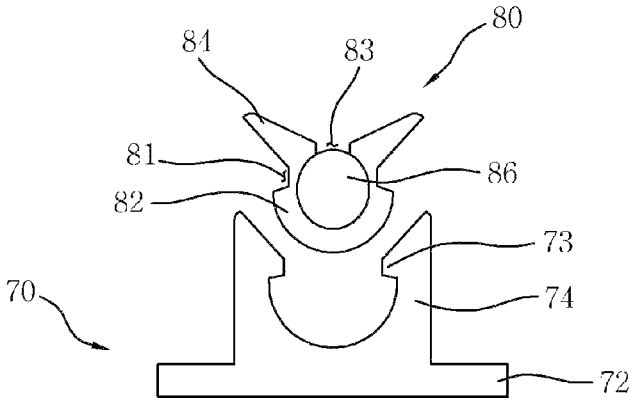
FIGS. 19*a*, 19*b*, and 19*c* are side views illustrating a connection process of the female holder and the male holder according to the exemplary embodiment of the present invention.
Figure 19B:
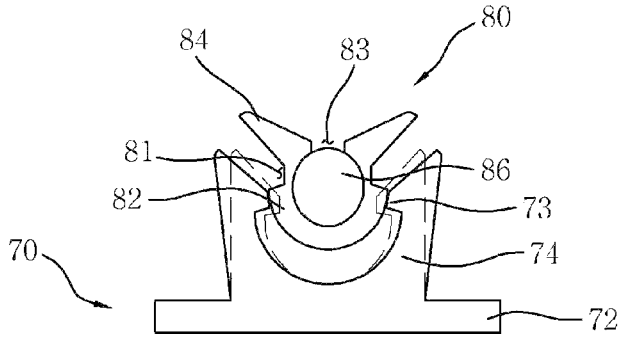
Figure 19C:
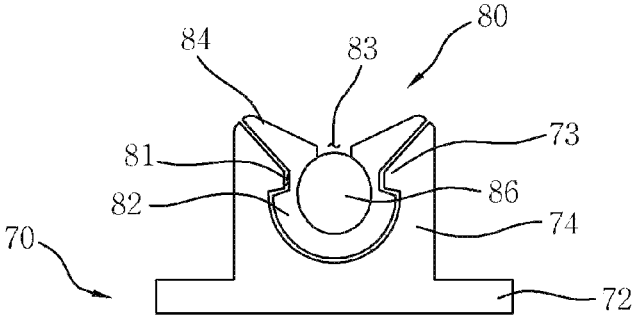

First, as illustrated in FIG. 19*a*, the female holder 70 and the male holder 80 are disposed and the coupling protrusion 82 of the male holder 80 begins to be fitted in the inlet of the receiving protrusion 74 of the female holder 70. In this case, since the inlet width of the receiving protrusion 74 is narrower than the thickness of the coupling protrusion 82 due to the locking protrusion 73 which is formed inside of the inlet of the receiving protrusion 74, as illustrated in FIG. 19*b*, the phenomenon that the receiving protrusion 74 is expanded may occur. The phenomenon may occur since the female holder 70 according to the exemplary embodiment of the present invention is made of a flexible material such as plastic. Further, when the coupling protrusion 82 is completely received in the receiving protrusion 74, as illustrated in FIG. 19*c*, the locking protrusion 73 is locked to the locking groove 81, such that the male holder 80 is supported to the female holder 70 and the cord 40 is fixed therebetween by the friction force.

The invention claimed is:

1. A cord embedded roman shade, comprising:

a first curtain including first warps and first wefts woven with the first warps;

a second curtain including second warps and second wefts woven with the second warps;

a connection belt extending in a horizontal direction and connecting the first curtain to the second curtain;

a cord fixed to lower ends of the first curtain and the second curtain, the cord passing through the connection belt; and a curtain adjusting member connected to one end of the cord, wherein some of the first warps of the first curtain intersect some of the second wefts of the second curtain, and some of the second warps of the second curtain intersect some of the first wefts of the first curtain, and wherein the connection belt includes the first warps intersecting the second warps.

2. The cord embedded roman shade of claim 1, further comprising:

a third curtain disposed between the first curtain and the second curtain, the third curtain including third warps and third wefts woven with the third warps, wherein the cord repeatedly passes between the third wefts.

3. The cord embedded roman shade of claim 1, wherein the connection belt includes some of the first warps twisted with some of the second warps.

4. The cord embedded roman shade of claim 1, wherein the first wefts intersect the first and second warps, the second wefts intersect the second and first warps, and the connection belt includes the first wefts intersecting the second wefts.

5. The cord embedded roman shade of claim 2, wherein the curtain adjusting member includes:

a frame having two ends;

a rotating bar having two ends, the rotating bar being disposed in the frame and fixed to one end of the cord, both ends of the rotating bar being connected to both ends of the frame, the rotating bar being fixed to upper ends of the first and second curtains; and a tow rope adjusting a rotation of the rotating bar.

6. The cord embedded roman shade of claim 1, wherein the cord is further provided with a gap holding member.

7. The cord embedded roman shade of claim 1, further comprising:

an auxiliary cord having a first end fixed to upper ends of the first curtain and the second curtain, and a second end end fixed to lower ends of the first curtain and the second curtain, the auxiliary cord passing through the connection belt, wherein the auxiliary cord includes a fixed bead.

8. The cord embedded roman shade of claim 1, further comprising:

a female holder connected to the first curtain or the second curtain, having a cylindrical shape and being open on one side, one end of the cord being disposed in the female holder; and a male holder fitted in an opening of the female holder and pressing the cord.

9. The cord embedded roman shade of claim 8, wherein the female holder includes:

a female holder body; and a pair of receiving protrusions mounted at an outer circumferential surface of the female holder body and in parallel to each other, and wherein the male holder includes:

a coupling protrusion fitted between the receiving protrusions; and a pair of wings mounted at a back side of the coupling protrusion and in parallel to each other to be locked to ends of the receiving protrusions.

10. The cord embedded roman shade of claim 9, wherein insides of the receiving protrusions each are further provided with locking protrusions, and sides of the coupling protrusion correspond to the locking protrusions and further include locking grooves.

11. The cord embedded roman shade of claim 9, wherein the coupling protrusion is provided with a cutting slit and an inside of the cutting slit is further provided with a shape holding member.

12. The cord embedded roman shade of claim 9, wherein ends of the receiving protrusions are formed to be inclined from outside to inside and the wings are mounted to be inclined so as to engage the ends of the receiving protrusions.

13. The cord embedded roman shade of claim 8, wherein an end of the female holder is open and the male holder is slidably positioned in the female holder.

14. A cord embedded roman shade, comprising:

a first curtain including first warps, and first wefts woven with the first warps;

a second curtain including second warps and second wefts woven with the second warps;

a connection belt extending in a horizontal direction and connecting the first curtain to the second curtain;

a cord fixed to lower ends of the first curtain and the second curtain, the cord passing through the connection belt; and a curtain adjusting member connected to one end of the cord, wherein the connection belt includes some of the first warps of the first curtain twisted with some of the second warps of the second curtain.

15. The cord embedded roman shade of claim 14, further comprising:

a third curtain disposed between the first curtain and the second curtain, the third curtain including third warps and third wefts woven with the third warps, wherein the cord repeatedly passes between the third wefts.

16. A cord embedded roman shade, comprising:

a first curtain including first warps, and first wefts woven with the first warps;

a second curtain including second warps and second wefts woven with the second warps;

a connection belt extending in a horizontal direction and connecting the first curtain to the second curtain;

a cord fixed to lower ends of the first curtain and the second curtain, the cord passing through the connection belt; and a curtain adjusting member connected to one end of the cord, wherein the first wefts of the first curtain intersect the second warps of the second curtain, and the second wefts of the second curtain intersect first warps of the first curtain, and wherein the connection belt includes the first wefts intersecting the second wefts.

17. The cord embedded roman shade of claim 16, further comprising:

a third curtain disposed between the first curtain and the second curtain, the third curtain including third warps and third wefts woven with the third warps, wherein the cord repeatedly passes between the third wefts.

* * * * *